US005085532A

United States Patent [19]

Surya et al.

[11] Patent Number: 5,085,532

[45] Date of Patent: Feb. 4, 1992

[54] MULTIPLE RIBBON MANDRIL FOR MULTIPLE PRINT HEAD PRINTERS

[75] Inventors: Ronald V. Surya, Laguna Hills; Albert M. Kritz, Laguna Niguel, both of Calif.

[73] Assignee: Pierce Companies, Inc., Santa Ana, Calif.

[21] Appl. No.: 480,221

[22] Filed: Feb. 15, 1990

[51] Int. Cl.[5] ..... B41J 33/22

[52] U.S. Cl. ..... 400/234; 400/232; 400/236.2; 192/41 R; 242/56.9; 403/357; 403/372

[58] Field of Search ..... 400/208, 207, 232, 236.2, 400/234; 242/56.9; 403/357, 372; 192/41 R

[56] References Cited

U.S. PATENT DOCUMENTS

| | | | |
|---|---|---|---|
| 320,375 | 6/1885 | Manning | 242/56.9 |
| 327,511 | 10/1885 | Barber | 242/56.9 |
| 759,757 | 5/1904 | Scott . | |
| 1,075,142 | 10/1913 | Deming . | |
| 2,468,867 | 5/1949 | Collins | 192/45.1 |
| 2,500,168 | 3/1950 | DuPont | 180/19 |
| 2,569,861 | 10/1951 | Moore et al. | 301/36 |
| 2,998,874 | 10/1961 | MacNeill | 192/45.1 |
| 3,109,603 | 11/1963 | Berlant | 242/55.12 |
| 3,130,604 | 4/1964 | Johnson et al. | 74/650 |
| 3,303,722 | 2/1967 | Boggs | 74/650 |
| 3,407,882 | 10/1968 | Wooden | 403/372 |
| 3,419,590 | 2/1969 | Kisling | 403/357 |
| 3,430,994 | 3/1969 | Keeler | 403/372 |
| 3,466,777 | 9/1969 | Phillips | 403/357 |
| 3,515,417 | 6/1970 | Bowman | 403/372 |
| 3,558,165 | 1/1971 | Lundergan | 403/372 |
| 3,685,757 | 8/1972 | Fedor | 192/41 R |
| 3,923,132 | 12/1975 | Van Der Klugt | 192/41 R |
| 3,964,833 | 6/1976 | Manriquez | 403/357 |
| 3,994,608 | 11/1976 | Swiderski et al. | 403/357 |
| 4,184,576 | 1/1980 | Kulischenko et al. | 192/41 R |
| 4,195,944 | 4/1980 | Cross | 403/372 |
| 4,358,215 | 11/1982 | Rivin | 403/357 |
| 4,514,109 | 4/1985 | McKenna | 403/370 |
| 4,593,864 | 6/1986 | Strome | 242/56.9 |
| 4,776,711 | 10/1988 | Harada | 400/82 |
| 4,784,555 | 11/1988 | Cantrell | 403/372 |
| 4,796,412 | 1/1989 | O'Neill | 53/473 |
| 4,869,357 | 9/1989 | Batchelder | 192/41 R |

FOREIGN PATENT DOCUMENTS

| | | | |
|---|---|---|---|
| 0069289 | 5/1949 | Denmark | 403/357 |
| 2361574 | 10/1975 | Fed. Rep. of Germany | 403/357 |
| 0121979 | 6/1986 | Japan | 400/236.2 |
| 0196158 | 8/1987 | Japan | 400/236.2 |
| 1030432 | 5/1966 | United Kingdom | 403/372 |
| 1365477 | 8/1971 | United Kingdom | 403/372 |

*Primary Examiner*—Edgar S. Burr
*Assistant Examiner*—John S. Hilten
*Attorney, Agent, or Firm*—Price, Gess & Ubell

[57] ABSTRACT

In medium to high volume printers using more than one print head, multiple documents may be printed side by side in one pass. Multiple rolls of ribbon are utilized on the ribbon mandril to accommodate the documents. The ribbon is kept taut across its print head by the feed system controller. When the outside diameters of the two rolls of ribbon vary, the system keeps one ribbon taut and the other tends to go slack at the print head. A split sleeve mandril with a differential mechanism connecting the two sleeves of the mandril assures that both ribbons are maintained taut. The preferred differential mechanism may be a planetary gear arrangement, or a thrust bearing arrangement. A unique ribbon roll holding mechanism, to hold the ribbon roll at the selected place on the mandril is also provided.

20 Claims, 5 Drawing Sheets

MULTIPLE RIBBON MANDRIL FOR MULTIPLE PRINT HEAD PRINTERS

BACKGROUND OF THE INVENTION

1. Field of the Invention

The present invention relates to supply or take-up mandrils for ribbon material in a system that requires the ribbon material to be kept taut throughout its path of travel, and more particularly pertains to new and improved take-up or supply mandrils for use in printing mechanisms having more than one printing head per machine.

2. Description of the Prior Art

In the field of multiple print head printers and specifically, high speed drum type impact printers designed for imprinting alpha-numeric characters and MICR on documents, it has been the practice to mount separate ribbon rolls on a single supply mandril in the system. One roll of ribbon would contain regular ink for alphanumeric printing. The other roll of ribbon would contain magnetic ink for the printing of the MICR code. The mandril is in a driven system designed to supply a taut ribbon across a print head. In those instances where one roll of ribbon has a greater diameter than another roll of ribbon, due to manufacturing differences or due to one roll being half used, the diameter of the two rolls vary. As a result, there will be a difference between the speed of the two ribbons. The smaller diameter ribbon roll must travel faster than the larger diameter one to dispense the same amount of ribbon. The feedback mechanism of the printer system controls the supply mandril based upon the one ribbon that is taut. The other ribbon will not be so controlled, causing it to exhibit slack across the print head. The degree of slackness will depend upon the diameter difference between the two rolls.

Any degree of slackness can not be tolerated, because it creates fuzziness in the letters being printed. The slight fuzziness which may be tolerable in alphanumeric printing, is intolerable when MICR code is being printed. In order to overcome this critical problem, the present invention provides a split mandril mechanism that simply replaces the single mandrel of the prior art with no changes to the ribbon control system of the printer being required. The split mandril of the present invention allows the ribbon rolls mounted thereon to rotate at different speeds.

SUMMARY OF THE INVENTION

To provide a taut ribbon across the print head, the mandril is driven with a live axle. The different rotary speeds required for different diameter ribbon rolls is accommodated by having multiple sections of the mandril that are allowed to rotate at different speeds with respect to the live axle. A differential mechanism connects the live axle to the separately rotating sleeve sections of the mandril that surround the axle. The differential mechanism allows one sleeve section of the mandril to rotate faster than the other, while at the same time rotatably driving all the mandril sleeve sections with the rotary force being applied to the live axle. In one preferred embodiment, a planetary gear assembly is pinned to the live axle. It drives each mandril sleeve section through a washer gear that is keyed to that mandril sleeve. In another preferred embodiment, a thrust bearing is pinned to the live axle. It drives each mandril sleeve section through a thrust washer and torque plate which is keyed to that mandril sleeve.

Each separate mandril sleeve utilizes its own mechanism for holding the ribbon roll in place on its sleeve. A small diameter elastic material is stretched the length of the mandril sleeve and fastened at each end. After the ribbon roll is placed on the sleeve over the stretched elastic, the ribbon roll is twisted with respect to the sleeve causing the stretched elastic on the surface of the mandril sleeve to shift position and lock the ribbon roll in place.

BRIEF DESCRIPTION OF THE DRAWINGS

The exact nature of this invention as well as its objects and advantages, will be readily apparent from consideration of the following specification as related to the accompanying drawings in which like reference numerals designate like parts throughout the figures thereof and wherein.

DETAILED DESCRIPTION OF THE PREFERRED EMBODIMENTS

Figure 1:
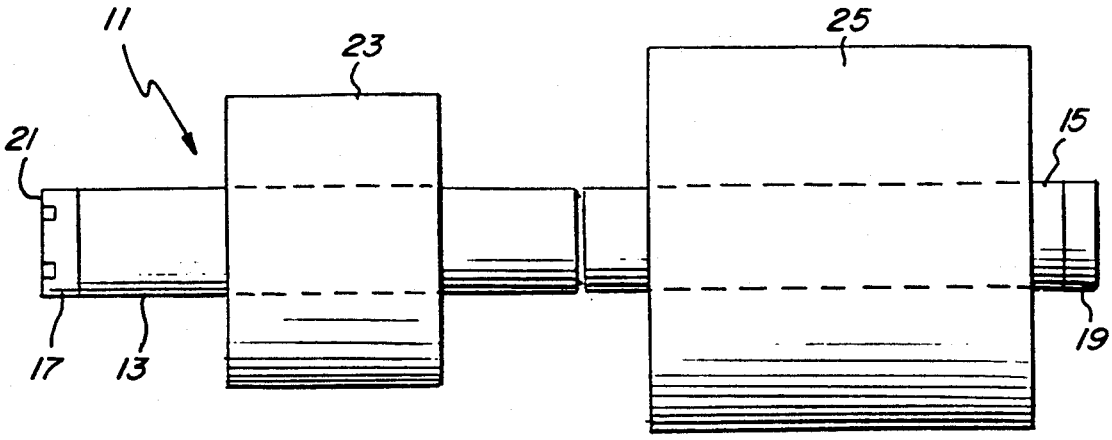
FIG. 1 is a diagrammatic illustration of the split mandril of the present invention having two rolls of ribbon mounted thereon.

Referring first to FIG. 1, the split mandril 11 of the invention is shown as including two sleeve sections 13 and 15, each of which carries a roll of ribbon 23 and 25 respectively. The mandril 11 has end caps 17 and 19 at each end which connect to the drive mechanism (not shown) of the ribbon control system of the printer. End cap 17 has notches 21 which engage with mating teeth in a drive wheel (not shown) that is part of the printer ribbon dispensing system.

Figure 2:
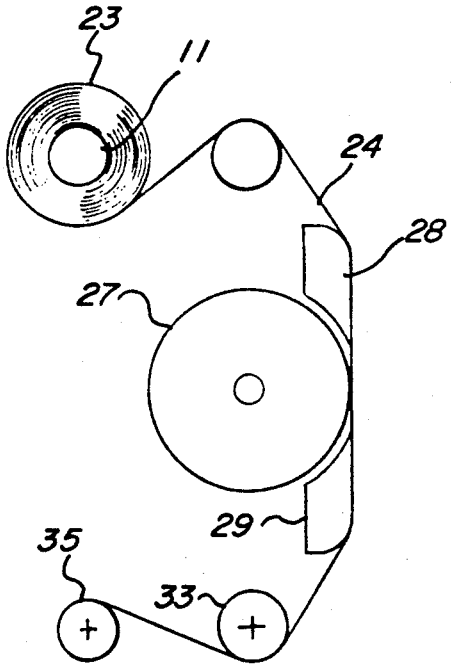
FIG. 2 is a diagrammatic side view of the path of travel of a ribbon when mounted on the supply side of the system.

FIG. 2 graphically illustrates the location of the major parts of a ribbon feed system. The roll of ribbon 23 is on a split mandril 11 located in the supply position.

The ribbon 24 from roll 23 rides over a guide roller 31 to drum guide 28, past the print drum 27 along the path dictated by drum guide 29, over take-up roller 33 to take-up mandril 35. As is well known in the art, the drum 27 carries alpha-numeric characters or MICR characters to be imprinted on paper that is fed past drum 27, adjacent to tape 24. Impact hammers (not shown) are normally located on the right side of the tape 24 and paper (not shown).

Figure 3:
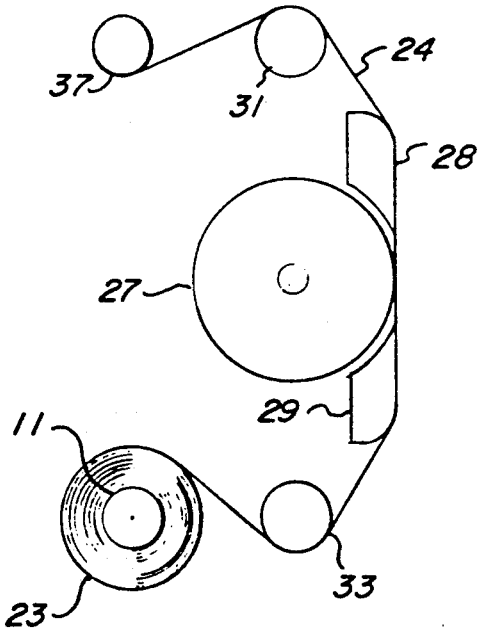
FIG. 3 is diagrammatic side view of the path of travel of a ribbon when mounted on the take-up side of the system.

FIG. 3 illustrates the split mandrel 11 with a roll of ribbon 23 in the take-up position. The split ribbon mandril may be placed in either the supply or take-up position in this particular system because it is a closed-loop system wherein both the take-up side 35 and the supply side 37 are driven in order to keep the ribbon 24 taut across the face of drum 27.

Figure 4:
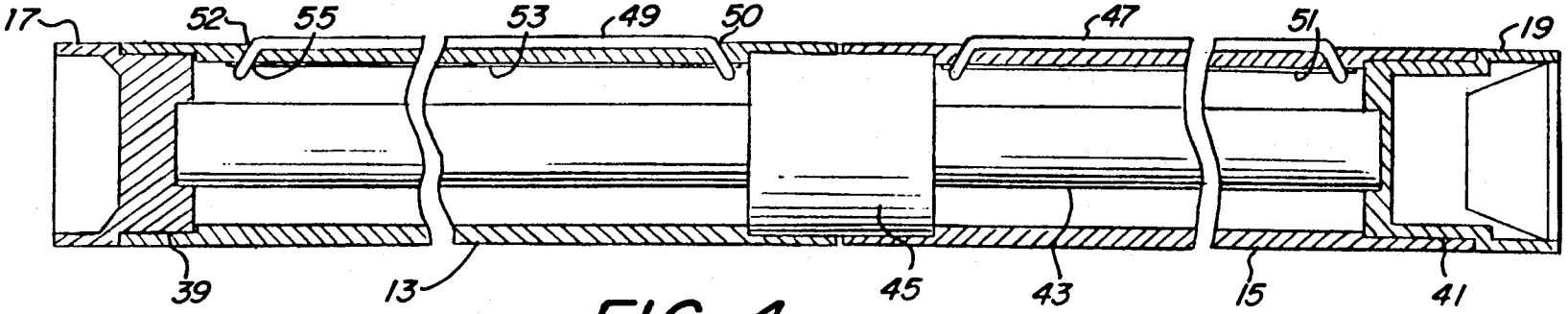
FIG. 4 is a cross-sectional view of the mandril diagrammatically illustrating its basic internal parts.

The basic construction of the split mandril according to the present invention is illustrated in FIG. 4. The split mandril has two sleeve sections, a left sleeve section 13 and a right sleeve section 15. Each sleeve section is hollow. The left sleeve section 13 has its left end riding on a bearing surface 39 which is a part of end cap 17. The right sleeve section 15 has its right end riding on a bearing surface 41 which is part of end cap 19. The right end of left sleeve 13 and the left end of right sleeve 15 meet in the center of the mandril. A differential mechanism 45 which will be explained in greater detail hereinafter is located in the center between the two sleeves.

A live axle 43 which is continuous from end cap 17 to end cap 19 even through the differential gear mechanism 45 is fixedly attached to both end caps. In operation, the differential mechanism 45 will allow sleeve 13 to rotate at a different speed than sleeve 15. Both sleeves are being driven by the rotary motion of live axle 43 and, end cap 17 which is keyed to a drive wheel (not shown) of the printer.

Figure 5:
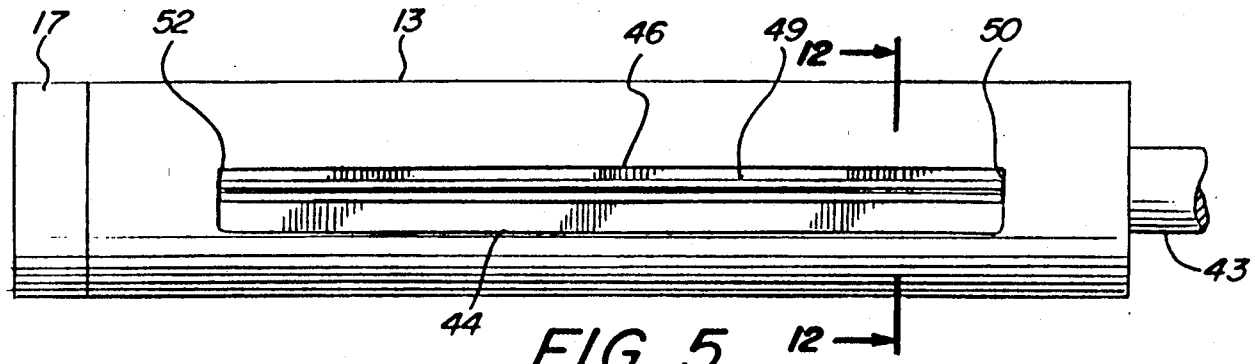
FIG. 5 is a view of one of the sleeves of the mandril according to the present invention.
Figure 12:
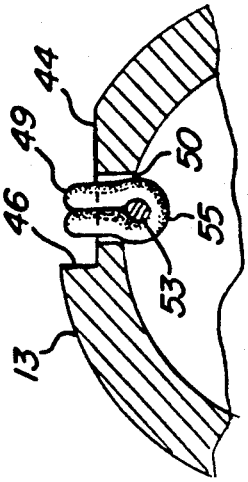
FIG. 12 is a partial cross-section of FIG. 5 along 12—12, showing the ribbon roll holding device.

The split mandril illustrated in FIG. 4 is designed to accommodate two ribbon rolls. Accordingly, the split mandril of FIG. 4 utilizes a ribbon roll holding mechanism 49 for the left sleeve 13 and a different ribbon roll holding mechanism 47 for the right sleeve 15. As is better illustrated in FIG. 5, the holding mechanism 49 is essentially a continuous loop of elastic material stretched parallel within a notched out area in the surface of the sleeve. The notch is formed by a wall 46 and a floor 44 perpendicular thereto (FIG. 12). It is preferred that this elastic material comprise an O-ring of suitable loop size and diameter. Each end of the O-ring 49 is inserted through respective aperture 50 and 52 in the floor 44 of the notch 13. Referring to FIGS. 12, 4 and 5, the loop 55 formed at each end at the undersurface of the sleeve 13 is held by means of a rod 53. The rod is inserted through the loop at each end. The ribbon holding mechanism 47 for the right sleeve 15, is likewise constructed and held in place by its rod 51. It should be understood, of course, that rather than being a single continuous rod as illustrated, two individual rods of shorter length, one at each end, may be utilized. Or any such similar holding mechanism for keeping the ends of the elastic member in their respective apertures 50, 52 may be utilized.

Figure 13:
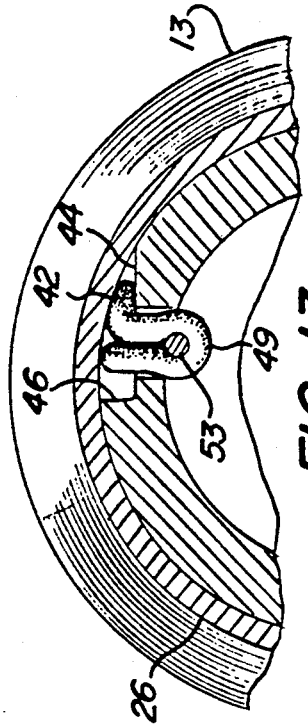
FIG. 13 is a partial cross-section of FIG. 5 showing the ribbon roll holding device engaged with a ribbon roll.

FIG. 13 illustrates the holding function of the holding mechanism 49. The stretched O-ring and the notch work together as follows. The notch illustrated in FIG. 13 is a left hand notch in that the floor 42 extends to the left from the wall 46. By turning the ribbon roll 23 clockwise with respect to the sleeve 13, the core 26 of the ribbon roll 23 catches one stretched element 42 of O-ring 49 and forces it into a wedge shape. This force between the underside of the core 26 and floor 44 is sufficient to hold the ribbon roll for all operative purposes. To release the ribbon roll, it is simply turned counterclockwise to "de-wedge" the stretched element 42. The notch could be reversed, then the fastening and loosening operation would also be reversed.

Figure 6:
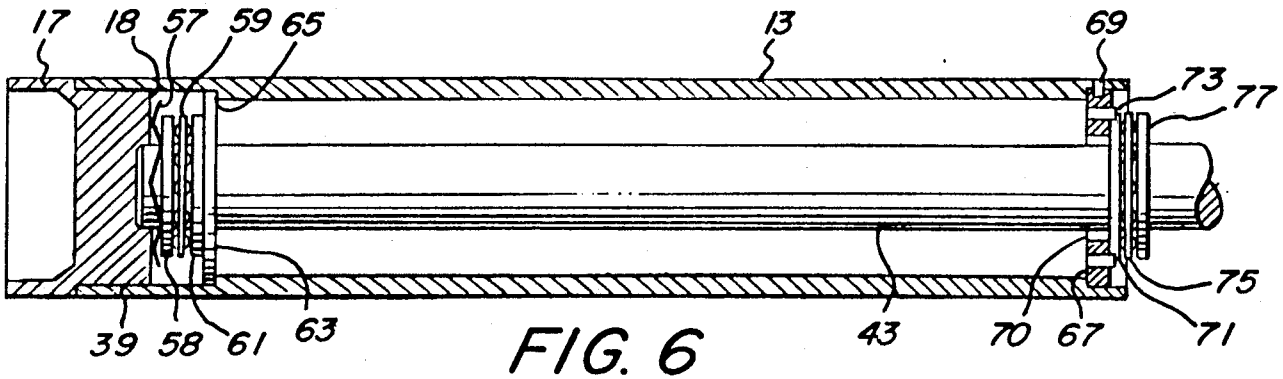
FIG. 6 is a cross-sectional view of the sleeve of FIG. 5 showing one type of differential mechanism utilized in the mandril.

Referring now to FIG. 6, a more detailed view of one of the preferred embodiments for the differential mechanism that can be used in the split mandril of FIG. 4 is illustrated. FIG. 6 shows the left half of the split mandril of FIG. 4. The cylinder 13 is cut away to show the left half of live axle 43. The left end of live axle 43 is attached to end cap 17 in a manner that will be hereinafter described. Cylinder 13 rotates on the bearing surface 39 of end cap 17 independently of the rotation of live axle 43.

The left end of live axle 43 is suspended and acted upon by a system that consists of thrust spring 57, thrust washer 58, thrust bearing 59, thrust washer 61 and thrust plate 63. Each of these above-named items has an aperture in its center through which live axle 43 freely passes without interference. Thrust plate 63 butts up against a shoulder 65 built into sleeve 13. The inside end 18 of end cap 17 squeezes this thrust bearing assemblage between its inside surface 18 and thrust plate 63 causing a slight compression of thrust spring 57. The compression is preferably adjusted for a firm fit without inhibiting the rotary motion of live axle 43 in conjunction with the rotation of end cap 17, which in this particular example, is the driving end cap.

The differential gear mechanism maintained in the center of live axle 43 is partially shown in FIG. 6 in greater detail, including the left half of the preferred embodiment of the gear mechanism. The right end of sleeve 13 has a torque plate 67 keyed to sleeve 13 by a key arrangement 69. Torque plate 67 has an aperture 70 through which live axle 43 passes freely. A thrust washer 71 is keyed to torque plate 67 by a pin 73. Accordingly, as sleeve 13 rotates, so does torque plate 67 and thrust washer 71. A thrust bearing 75 similar in construction to thrust bearing 59 at the left end of live axle 43 is located between thrust washer 71 and thrust washer 77.

Figures 7, 8:
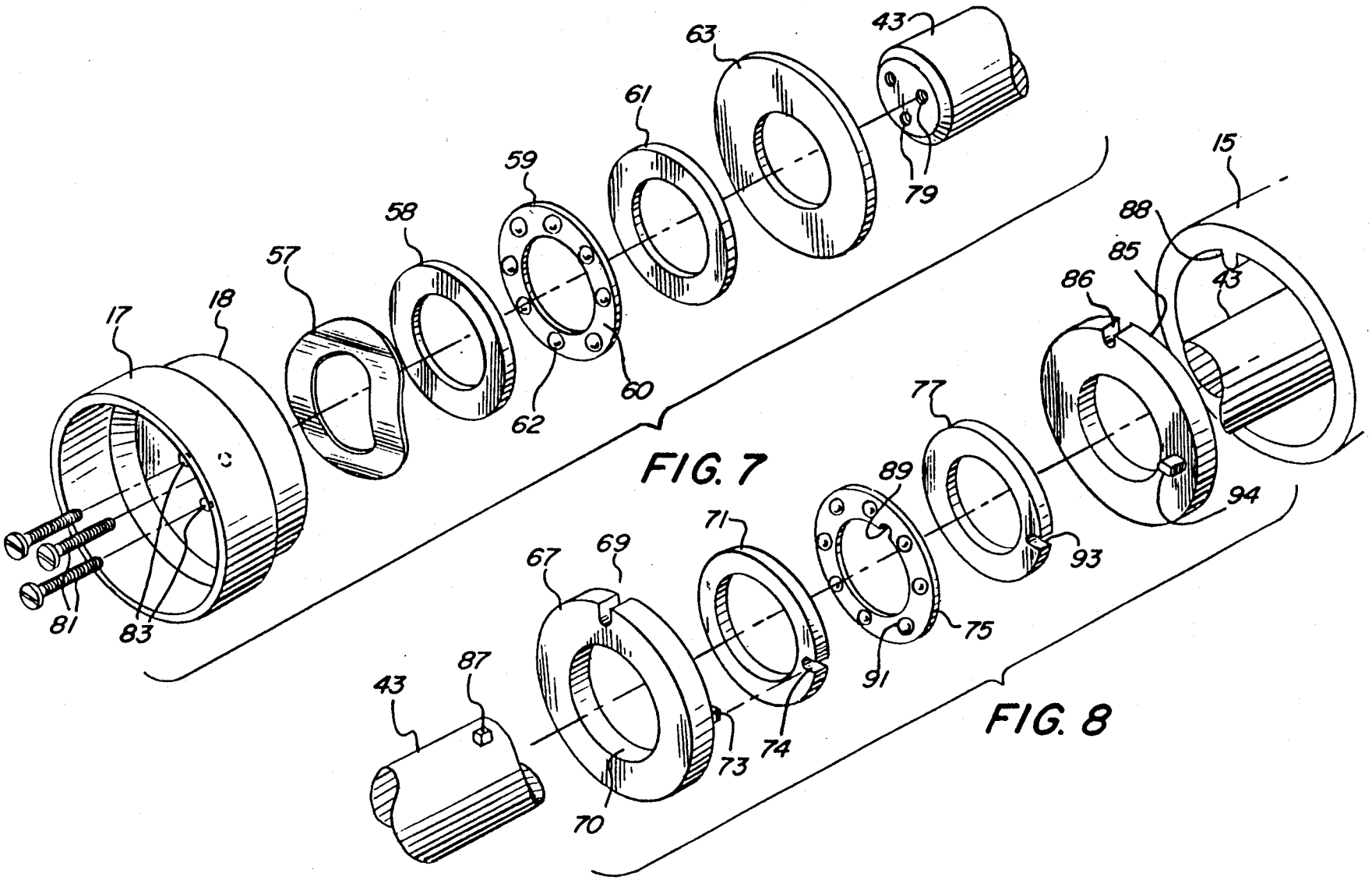
FIG. 7 is an exploded view showing the live axle and mounting mechanism for the differential mechanism shown in FIG. 6.
FIG. 8 is an exploded view showing the differential mechanism of FIG. 6.

A more detailed view of the differential gear structure of FIG. 6 is shown in the exploded views of FIG. 7 and FIG. 8. After review of the structure of these illustrated components, the operation of the differential mechanism will be described.

The left end of live axle 43 fastens to end cap 17. One preferred fastening method is by screws 81 that pass through apertures in the inside end 18 of end cap 17 and into threaded apertures 79 in the end of live axle 43. Live axle 43 passes through the internal aperture of thrust plate 63, the internal aperture of thrust washer 61, the internal aperture of thrust bearing 59, the internal aperture of thrust washer 58 and the internal aperture of thrust spring 57. As shown in FIG. 6, the entire assemblage is squeezed together between thrust plate 63 and the inside end 18 of end cap 17, when assembled. Thrust bearing 59 is simply a washer-type plate 60 having apertures therein containing ball bearings 62. This entire structure is designed to apply a force to the differential mechanism in the center of the live axle 43 (FIG. 8), while at the same time allowing the end of live axle 43 to rotate freely without undue friction which would cause the end parts to wear out.

The differential mechanism of FIG. 6 is more clearly illustrated in the exploded view of FIG. 8. The differential mechanism consists of the torque plate 67, which is keyed to the left sleeve 13 (not shown) by a slot 69 that fits into a key inside the sleeve 13. Thrust washer 71 is keyed to the torque plate 67 by key pin 73 and slot 74 on thrust washer 71. Thrust washer 75 has ball bearings 91 therein. Thrust washer 77 is keyed to torque plate 85 by pin 94 on the torque plate engaging slot 93 on the thrust washer 77. Torque plate 85 is keyed to sleeve 15 by slot 86 engaging key 88 in the underside of sleeve 15.

Thrust bearing 75 has a notch 89 on the perimeter of its inside aperture which engages a key pin 87 on live axle 43. As a result, thrust bearing 75 rotates with live axle 43. When assembled, all the elements of the differential mechanism: left torque plate 67, left thrust washer 71, thrust bearing 75, right thrust washer 77, and right torque plate 85 are squeezed together. The apertures of both torque plates and thrust washers are large enough to allow free passage of live axle 43. Only thrust washer 75 is physically driven by live axle 43.

As a result of the force applied from both end mechanisms as illustrated in FIG. 7 to the differential mechanism of FIG. 8, squeezing the entire assemblage together, the friction created between the ball bearings 91 and the thrust washers 71, and 77 causes thrust washers 71 and 77 to rotate with the thrust bearing 75. Because of this rotation, thrust washers 71 and 77 in turn will cause torque plates 67 and 85 to rotate. Because the torque plates are keyed to their respective sleeves 13 and 15, sleeves 13 and 15 will rotate. Any rolls of ribbon that are mounted on the individual sleeves 13 and 15 will be driven to rotate as well. If a differential force is created, as occurs when the diameters of the ribbon rolls are different, that force will tend to overcome the friction built into the differential mechanism of FIG. 8 and allow one sleeve to rotate faster or slower than the other because the thrust washers will be turning with respect to thrust bearing 75.

Figures 9, 10:
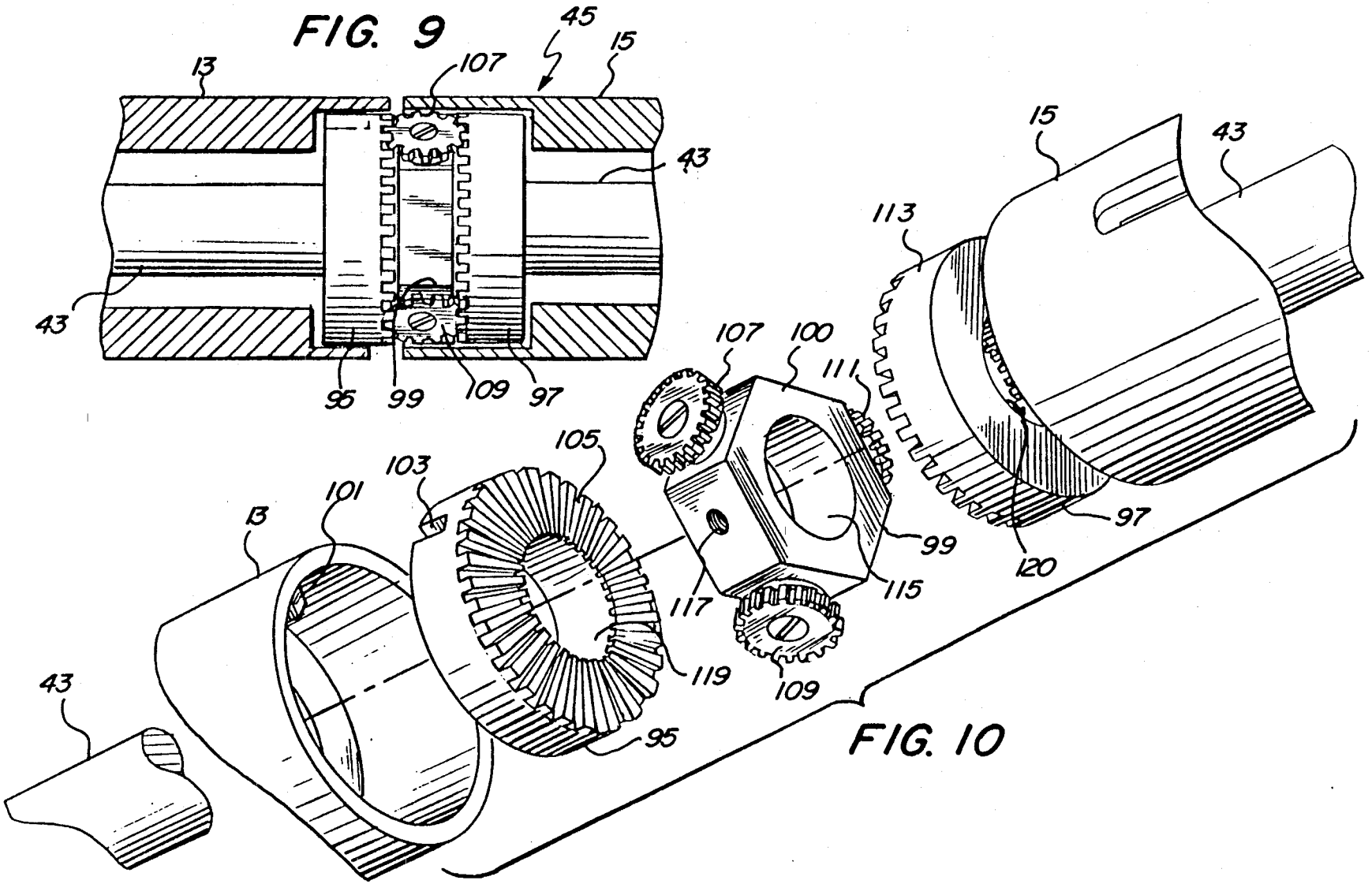
FIG. 9 is a partial cross-section showing an alternate preferred embodiment of the differential mechanism that could be used in the split mandrel of FIG. 4.
FIG. 10 is an exploded view of the differential gear mechanism of FIG. 9.

Referring now to FIGS. 9 and 10, another preferred embodiment of the differential mechanism 45 is illustrated as located in the center of live axle 43 between the right end of sleeve 13 and the left end of sleeve 15. The differential mechanism consists of three basic parts, a left washer gear 95, a right washer gear 97, and a planetary gear assembly 99 in between them. Left washer gear 95 and right washer gear 98 are keyed to their respective sleeves 13 and 15. The planetary gear assembly 99 is pinned to live axle 43. These parts are more specifically illustrated in FIG. 10, which is a blow-up view of this differential gear mechanism.

The live axle 43 freely passes through the apertures such as aperture 119 and 120 in washer gears 95 and 97 respectively. Planetary gear assembly 99 also has an aperture 115 through which live axle 43 passes. Planetary gear assembly 99 is pinned to live axle 43 by means of a screw (not shown) threaded through threaded aperture 117 into live axle 43. Any other equivalent convenient pinning means may also be used. The left washer gear 95 is keyed to the left sleeve 13 by way of slot 103 on washer gear 95 and key 101 on the inside of sleeve 13. This same arrangement (not shown) exists for the right washer gear 97 with respect to right sleeve 15.

The planetary gear assembly 95 is shown as a hexagonal shaped carrier with an aperture 115 therethrough. The shape of the carrier may take on any other convenient form which will permit the mounting of the gears 107, 109 and 111 at equal distances from each other around the perimeter of the carrier 99. As can be seen, the planetary gears 107, 109 and 111 are mounted for rotation on shafts that are physically attached to the carrier along an axis that extends radially outward from the axis of symmetry of the carrier.

When assembled, the differential gear mechanism engages, as shown in FIG. 9. That is the planetary gears 107, 109 and 111, engage the teeth 105 of the left washer gear 95 and the teeth 113 of the right washer gear 97. Because the planetary gear assembly 99 is pinned to live axle 43, it will rotate with live axle 43. This rotation force is imparted through the individual planetary gears 107, 109 and 111 to both left and right washer gears 95 and 97 respectively, causing them to rotate with the planetary gear assembly 99. The rotation of the washer gears 95, 97 will cause rotation of their respective sleeves 13 and 15.

As long as the differential forces being exerted on sleeves 13 and 15 is relatively small, sleeves 13 and 15 will continue to rotate at the same speed. However, when the force differential increases, as will occur when the diameter differential between left and right ribbon rolls becomes greater, the planetary gears 107, 109 and 111 will begin to turn with respect to washer gears 95 and 97. This allows sleeves 13 and 15 to rotate at different speeds as required to keep the respective ribbons taut across their respective print heads.

Figure 11:
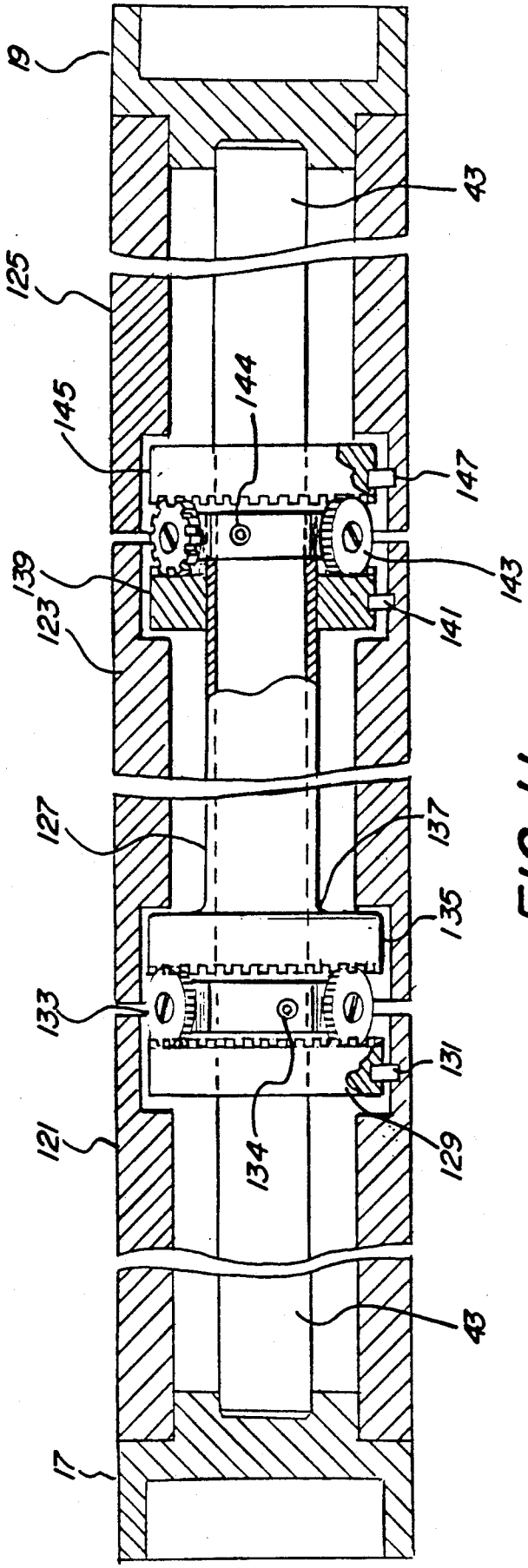
FIG. 11 is a partial cross-section of a three cylinder mandril showing the differential gear mechanisms between the three cylinders.

This differential gear arrangement may be extended to any number of sleeve sections on a mandril. An example of a three sleeve section mandril arrangement is illustrated in FIG. 11. A differential gear mechanism of the type shown in FIGS. 9 and 10 is located between each of the sleeve sections 121, 123 and 125. In the three section arrangement of FIG. 11, two live axles are utilized. The first is the main live axle 43. The second is a coaxial live axle 127 that extends substantially the length of the center section 123 and rotates around live axle 43 which passes through coaxial live axle 127.

Looking first at the differential mechanism between sections 121 and 123, we see the familiar arrangement of a left washer gear 129 keyed to sleeve 121, the planetary gear assembly 133 pinned by a mechanism 134 to live axle 43, and a right washer gear 135. In this specific instance, however, right washer gear 135 is fixedly attached to the left end of coaxial live axle 127 by appropriate weld or solder joints 137.

Looking now at the differential gear mechanism located between sleeves 123 and 125, we see a left washer gear 139, rotating around coaxial live axle 127 and keyed to sleeve 123 by key arrangement 141. A planetary gear assembly 143 is pinned by some mechanism 144 to coaxial live axle 127. The right washer gear 145 rotates about live axle 43 and is keyed to sleeve 125 by key mechanism 147.

Assuming there are no differential rotary forces being applied to the sleeve sections 121, 123, and 125, rotation of live axle 43 by way of drive end cap 17 will cause the following motion. The rotation of live axle 43 will cause planetary gear assembly 133 to rotate. This causes left and right washer gears 129 and 135 to also rotate. Left washer gear 129 causes sleeve 121 to rotate. Right washer gear 135 will cause live axle 127 to rotate.

Rotation of live axle 127 causes planetary gear assembly 143 to rotate. Rotation of planetary gear assembly 143 causes left washer gear 139 and right washer gear 145 to rotate. Because left washer gear 139 is keyed to sleeve 123, it will cause sleeve 123 to rotate. Because right washer gear 145 is keyed to sleeve 125, it will cause sleeve 125 to rotate. In this manner, all three independent sleeve sections 121, 123 and 125 will rotate together.

When the diameter difference between the various rolls of ribbon mounted on the sleeve sections 121, 123 and 125 becomes greater, these sleeves will start to rotate at different speeds with respect to each other, as required. Looking first at sleeve section 121, we can see that the left washer gear 129 has an aperture which allows live axle 43 to pass freely through it. If sleeve section 121 needs to rotate at a speed that is different from sleeve 123, it is free to do so by allowing planetary gear assembly 133 to revolve with respect to washer gear 129. Planetary gear assembly 133 may continue to remain stationary with respect to the right washer gear 135, thereby causing washer gear 135 to continue to revolve with planetary gear assembly 133.

Assuming that the force on sleeve section 123 was such that it needed to revolve at a speed that was different from sleeve section 121 and sleeve section 125, the differential gear mechanism between sleeve sections 123 and 125 would operate as follows. The planetary gear assembly 143 would rotate with respect to left washer gear 139 thereby allowing the central sleeve section 123 to which washer gear 139 is pinned to revolve at its required speed. Left washer gear 139 has an aperture there which coaxial live axle 127 passes freely. Right sleeve section 125 can either continue to revolve with planetary gear assembly 143 or at its own speed as dictated by the external force being applied to it. Right washer gear 145 which is keyed to right sleeve section 125 has an aperture though which live axle 43 passes freely. Thus, right sleeve section 125 can rotate with respect to planetary gear assembly 143 at its own required speed with respect to the other sleeve sections.

In this manner, the three rolls of ribbon (not shown) mounted on the three independent sleeve sections 121, 123, and 125 can rotate at separate speeds if required, in order to keep the respective ribbons taut across their respective print heads.

What is claimed is:

1. In a reel to reel system wherein multiple rolls of ribbon material are carried by a single mandril and each roll must be wound or unwound taut even when the diameters of the rolls vary, the improvement therein comprising:

a single mandril with multiple independently rotatable sleeve sections, one said sleeve section for each roll of ribbon to be carried by said mandril;

a differential mechanism connecting the independently rotatable sleeve sections together, thereby allowing the sleeve sections to rotate together at the same rotary speed or at different rotary speeds;

at least one length of highly elastic material having ends stretched along a length of each of said sleeve sections for a defined distance therealong; and means for fastening the ends of each said length of elastic material;

whereby a roll of ribbon may be slid on each of said sleeve sections over said length of elastic material, and locked to the sleeve section by a twist with respect to said sleeve section.

2. The improvement of claim 1 wherein said differential mechanism comprises:

a live axle rotating with in said mandril;

a gear arrangement pinned to said live axle between two sleeve sections;

a first washer gear rotating around said live axle and keyed to the sleeve section on the left side of said pinned gear; and a second washer gear rotating around said live axle and keyed to the sleeve section on the right side of said pinned gear;

whereby said pinned gear engages said first and section washer gears, causing both sleeves to rotate at the speed of the live axle or at a higher or lower speed, as required.

3. The improvement of claim 2 wherein said pinned gear arrangement comprises a planetary gear arrangement.

4. The improvement of claim 3 wherein said planetary gear arrangement comprises:

a ring carrier that slips on said live axle and is pinned thereto for rotation therewith;

a plurality of smaller gears each mounted for rotation about an axis that extends from said ring radially from its geometric center.

5. The improvement of claim 4 wherein said plurality of smaller gears comprise three equally spaced gears, with each smaller gear engaging said right and left washer gear.

6. The improved roll holding device of claim 1 wherein said length of elastic material comprises an O-ring.

7. The improved roll holding device of claim 6 wherein said means for fastening the ends of said O-ring comprises a rod extending through each end of said O-ring after each end has passed through its respective aperture in the sleeve section.

8. The improved roll holding device of claim 1 wherein each sleeve section further includes a notched out region within which said length of elastic material is located.

9. The improved roll holding device of claim 8 wherein the notched region in the sleeve section comprises a wall extending into the surface of the sleeve section and a floor extending from the wall longitudinally to the surface of the sleeve section.

10. In a multiple print head impact printer wherein ribbon is supplied to each printing head by a reel to reel system which is designed to keep the ribbon taut across the print head, an improved mandril for carrying three rolls of ribbon, comprising:

a single mandril with a first, second and third independently rotatable sleeve section;

a first differential mechanism connecting the first sleeve with the second sleeve;

a second differential mechanism connecting the second sleeve with the third sleeve, thereby allowing all three sleeve sections to rotate together at the same speed or at different speeds;

at least one length of highly elastic material having ends stretched along a length of each of said sleeve sections for a defined distance therealong; and means for fastening the ends of each said length of elastic material;

whereby a roll of ribbon may be slid on each of said sleeve sections over said length of elastic material, and locked to the sleeve section by a twist with respect to said sleeve section.

11. The improvement of claim 10 further comprising:

a first live axle running the length of the mandril from end to end; and a second live axle coaxial with said first live axle along the length of the second sleeve section of the mandrel.

12. The improvement of claim 11 wherein said first differential mechanism comprises:

a first gear arrangement pined to said first live axle between the first and second sleeve sections;

a first washer gear rotating around said first live axle and keyed to said first sleeve section; and a second washer gear rotating around said first live axle and pinned to the first end of said second live axle;

whereby said first gear arrangement engages said first washer gear and said second washer gear, causing the first sleeve ad the second liver axle to rotate at the speed of the first live axle or at a higher or lower speed, as required.

13. The improvement of claim 12 wherein said second differential mechanism comprises:

a second gear arrangement pinned to the second end of said second live axle;

a third washer gear rotating around said second live axle and keyed to said second sleeve section; and a fourth washer gear rotating around said first live axle and keyed to said third sleeve section;

whereby said second gear arrangement engages said third sleeve washer gear and said fourth sleeve washer gear, causing the second sleeve and the third sleeve to rotate at the speed of the second live axle, or at a higher or lower speed, as required.

14. The improvement of claim 13 wherein said pinned gear arrangements comprise planetary gear arrangements.

15. The improvement of claim 14 wherein each said planetary gear arrangement comprises:

a ring carrier that slips on said live axle and is pinned thereto for rotation therewith;

a plurality of smaller gears each mounted for rotation about an axis that extends from said ring carrier radially from its geometric center.

16. The improvement of claim 15 wherein said plurality of smaller gears comprise three equally spaced gears, with each smaller gear engaging said right and left washer gear.

17. The improved roll holding device of claim 10 wherein said length of elastic material comprises an O-ring.

18. The improved roll holding device of claim 17 wherein said means for fastening the ends of said O-ring comprises a rod extending through each end of said O-ring after each end has passed through its respective aperture in the sleeve section.

19. The improved roll holding device of claim 10 wherein each sleeve section further includes a notched out region within which said length of elastic material is located.

20. The improved roll holding device of claim 19 wherein the notched region in the sleeve section comprises a wall extending into the surface of the sleeve section and a floor extending from the wall longitudinally to the surface of the sleeve section.

* * * * *